United States Patent [19]

Whiteing

[11] Patent Number: 4,897,949

[45] Date of Patent: Feb. 6, 1990

[54] FIREARMS

[76] Inventor: Roland G. Whiteing, 45 Duncan Road, Glenferness, Midrand, South Africa

[21] Appl. No.: 216,718

[22] PCT Filed: Dec. 22, 1986

[86] PCT No.: PCT/GB86/00788

§ 371 Date: Jun. 23, 1988

§ 102(e) Date: Jun. 23, 1988

[87] PCT Pub. No.: WO87/03952

PCT Pub. Date: Jul. 2, 1987

[30] Foreign Application Priority Data

Dec. 23, 1985 [ZA] South Africa ..... 85/9792

[51] Int. Cl.[4] ..... F41C 7/02; F41D 5/02

[52] U.S. Cl. ..... 42/10; 42/11

[58] Field of Search ..... 42/10, 11, 69.02

[56] References Cited

U.S. PATENT DOCUMENTS

| | | | |
|---|---|---|---|
| 398,595 | 2/1889 | Emmens | 42/10 |
| 877,657 | 1/1908 | Mason | 42/11 |
| 886,211 | 4/1908 | Hino et al. | 42/11 |
| 1,179,880 | 4/1916 | Wesson | 42/11 |
| 2,102,199 | 12/1937 | Dixon | 42/10 |
| 2,699,006 | 1/1955 | Maerk | 42/10 |
| 2,835,998 | 5/1958 | Maerk | 42/10 |
| 2,963,810 | 12/1960 | Robinson | 42/15 |
| 3,680,241 | 8/1972 | Ramsay | 42/10 |

FOREIGN PATENT DOCUMENTS 2572507 5/1986 France .

OTHER PUBLICATIONS

Material Part of Firearm, Book One, Edited by A. A. Blagonravov, "Oborongiz"1 Publishers, Moscow 1945 English Translation of Russian Document.

*Primary Examiner*—David H. Brown

*Attorney, Agent, or Firm*—Cushman, Darby & Cushman

[57] ABSTRACT

A pump action shotgun including a main housing, a breech having a main bore and a sleeve within the main bore. A barrel has its rear end telescopically received within the sleeve, the barrel being axially movable from a rear firing position in close proximity to the breech to a forward loading position. The barrel is connected to the sleeve through a pin and groove arrangement so that axial movement of the barrel causes rotational movement of the sleeve. The sleeve being connected to the various mechanisms of the shot gun to operate these when it (the sleeve) is rotated.

12 Claims, 2 Drawing Sheets

FIREARMS

THIS INVENTION RELATES TO FIREARMS

Figure 1:
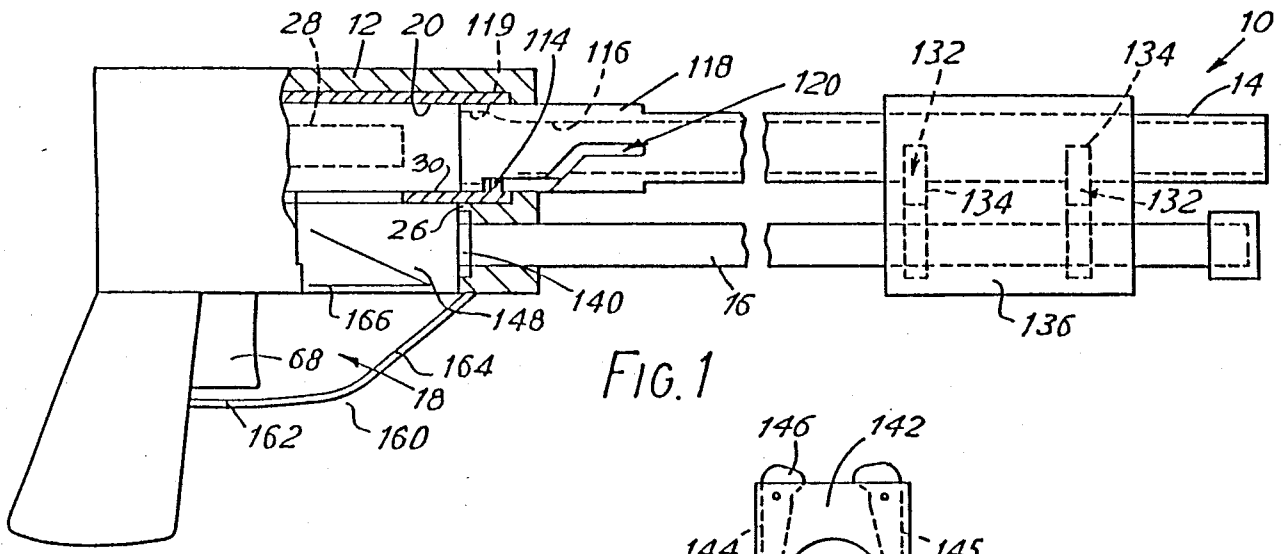

The invention is concerned with a firearm comprising a main housing having a main bore; a breech at one end of the main bore; a barrel having a bore therethrough and a rear end that is telescopically received within the main housing, the barrel being axially movable from a rear position in operative connection with the breech to a forward position; and a firing pin at the breech end of the main bore.

An object of the invention is to provide an improved firearm of this kind.

According to the invention the firearm is characterised in that the housing has a loading passsage through which a cartridge can be inserted into the main bore; and an eject passage through which a cartridge case can be ejected from the main bore and in that the barrel bore inhibits the cartridge casing from passing along the barrel.

In use a cartridge will be homed into the bore of the barrel on rearward movement of the barrel, the firing pin will activate the cartridge only when the cartridge is homed into the bore. The position of the rear of the barrel when it is in its rearward position is such that there will be an adequate sealing between the rear of the barrel and the breech.

Preferably there is further provided a sleeve rotatably fitting in the main bore and telescopically receiving the barrel, the sleeve having a port therein which corresponds in size and axial location to the magazine passage, there being engaging parts on the barrel and sleeve arranged to cause rotation of the sleeve on axial movement of the barrel; the arrangement being such that (i) when the barrel is in the forward position, the port will be adjacent the loading passage; and (ii) when the barrel is intermediate the forward and rear positions the port will be adjacent the eject passage.

The engaging means preferably comprise a cam groove in the barrel and a pin on the sleeve, the groove preferably comprises straight end portions with an inclined mid-portion so that the initial and terminal movement of the barrel is not accompanied by corresponding rotary movement of the sleeve. Suitable means are provided to ensure that the barrel does not rotate relative to the main housing. Where a tubular magazine is used, such means may comprise guides secured to the barrel and sliding over the magazine. A hand grip for use in "pumping" the barrel may be provided covering the guides.

The firing pin may preferably be mounted on a block which is spring loaded forwardly and which is moved rearwardly into the cocked position as a result of the axial movement of the barrel. Preferably there are corresponding cam surfaces on the outside rear of the sleeve and the block which engage when the sleeve is rotated to cause the said block to move as aforesaid.

The firearm may be a single acting weapon. In this arrangement, the firearm may have a firing mechanism that will engage the barrel to hold it in its rearward position, releasing it only on completion of the firing movement after the trigger has been released.

The firing mechanism preferably comprises a trigger, movable in use from a forward position to a firing position, and a rocker device, the rocker device being operatively connected to, preferably by having formed thereon, a sear and a locking pin and a cam surface, and the finger member having a cam member which engages the cam surface; the cam surface being arranged so that in use on initial movement of the trigger from its forward position the rocker device is caused to move so that the locking pin is moved into an operative position in which it operatively engages the barrel to hold it in its rearward position while on further movement of the trigger, the sear is moved to an inoperative position in which it permits the firing pin to move into its firing position. Preferably biassing means, preferably spring means, are provided for biassing the rocker device so that the sear is normally in its operative position.

The firearm may however also be an automatic weapon. In this arrangement, a spring device may be provided to biass the barrel into its backward position. When a cartridge is fired, the barrel will be moved forwardly relative to the main housing by the explosive gasses into its forward position.

An embodiment of the invention will now be described by way of example with reference to the accompanying diagrammatic drawings.

Figure 3:
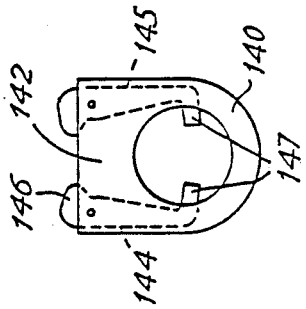
Figure 2:
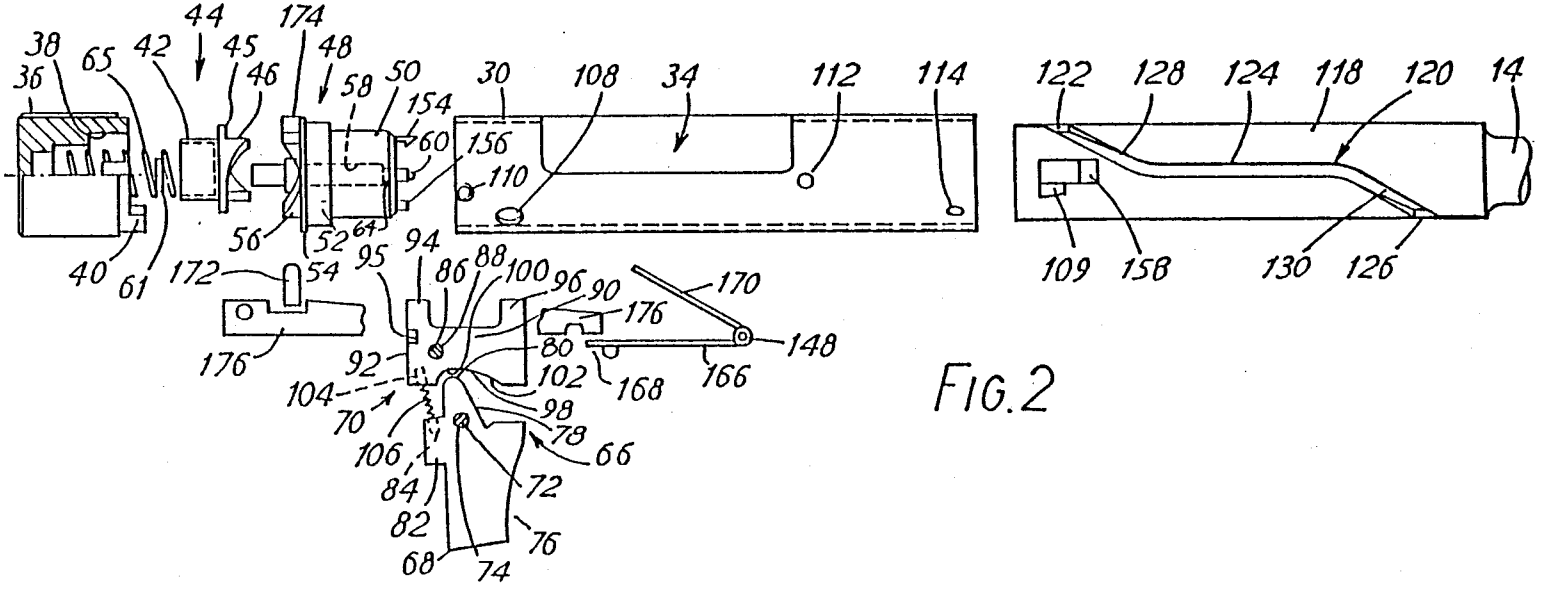

In the drawings:

FIG. 1 is a side view partially in section of a shot gun of the invention, certain parts being omitted as not being relevant to the invention, and FIG. 2 is an exploded view of showing certain parts of the shot gun, and FIG. 3 is a detail showing a magazine control device.

Referring now to the drawings, there is shown a pump action shotgun 10 comprising a rear block 12, a barrel 14, a tubular magazine 16 and a trigger device 18. The drawing does not show certain well known parts of a shotgun including the stock and aiming sights, the ommission of which will be appreciated by those skilled in the art and the construction of which is conventional.

The rear housing or block 12 is machined from an aluminium extrusion having a main bore 20 which is closed at one end. The other end of the main bore 20 is open. A loading passage 26 is cut through the lower portion of the block and communicates with the magazine 16. An eject passage 28 is cut through the block 12 at right angles to the position at which the loading passage 26 is provided and it is aligned therewith.

A hollow rotary sleeve 30 is rotatably received within the main bore 20. An elongated slotted port 34 is formed in the cylindrical wall of the sleeve 30. The port 34 is of the same dimensions as the loading passage 26.

The rear end of the bore 20 threadedly receives and is closed by a cam member 36 having a close ended square section central aperture 38. A low cam 40 subtending about 30° at the centre is formed on the front face of the cam member 36 for the reasons that will be set forth below. Slidably received within the aperture 38 is a hollow square section boss 42 of a firing pin cam 44 having a central flange 45 on the front face of which are a pair of cams 46 each subtending about 90° at the centre.

A cylindrical breech 48 closes off the rear of the sleeve 30. The breech 48 has a forward portion 50 that fits in the sleeve 30 with an annular space there-around. Behind its central portion 52 the breech has a flange 54 on the rear face of which are a pair of cams 56 that correspond to the cams 46, the cam faces bearing on each other. A bore 58 extends through the breech 48 for a firing pin 60. The bore 58 has an end throat through which only the reduced diameter front end 64 of the pin 60 can pass. The rear end of the firing pin 60 is passes through the firing pin cam 44 and is held by a nut 61.

A firing spring 65 is received within the boss 42 and urges the firing pin cam 44 and with it the firing pin 60 forwardly.

A firing mechanism 66 comprises a trigger 68 and a rocker device 70.

The trigger 68 is pivotted about a pivot pin 72 that passes through a bore 74 near its upper end. The trigger 68 has a shaped finger grip 76 on its lower portion. Above the pivot pin 72 there is a cam member 78 having a rounded upper nose 80. There is a rear projection 82 on the side of the trigger 68 at the level of the bore 74. A shallow cylindrical vertical bore 84 is formed in the projection 82.

The rocker device 70 is generally "H" -shaped in side view. It is pivotted about a pivot pin 86 that passes through a bore 88 at the junction of the cross-part 90 and the rear vertical part 92. The upper portion of the vertical part 92 constitutes a sear 94 that in its operative position lies in the path of movement of the flange 45 of the firing pin cam 44. The upper portion of the forward vertical part 96 constitutes a lockup-pin. The lower portion of the cross-part 90 is in the form of a cam surface 98 having a recess portion 100 in which the nose 80 is received and an inclined surface 102 running from the recess portion 100.

An opening 95 in the rocker device 70 is provided to receive a safety pin as will be described.

A shallow cylindrical vertical bore 104 is formed in the lower portion of the rear vertical part 92 A compression spring 106 has its ends received respectively in the bores 84 and 104. The spring 106 biasses the sear 94 upwardly into an operative position to engage the flange 45 firing pin cam 44. It also biasses the trigger 68 forwardly.

On pulling the trigger 68, the nose 78 runs along the cam surface 98 causing the rocker member 90 to pivot (counter clockwise in the drawing) about the pivot pin 86, moving the lock-up pin 96 through an opening 108 in the sleeve 30 to engage in an opening 109 in the barrel 14. Further pulling of the trigger 68 causes the sear 94 to drop into an inoperative position out of the path of the flange 54 permitting the firing pin 60 to be thrown forwardly by the firing spring 65.

It will be seen that if the barrel 14 is not in its rearward position, the locking pin 96 will not be able to engage the opening 109 in the barrel and consequently the rocker member will be unable to move sufficiently to move thse sear 94 into its inoperative position. Consequently the firing pin 60 cannot in these circumstances operate.

A trigger guard is provided. This is described below.

The sleeve 30 has an opening 110 at its rear end. It further has an external cam 112 and an internal pin 114 axially spaced respectively at its forward end.

The barrel 14 has a bore 116 therethrough. The rear end 118 of the barrel 14 is of enlarged outside diameter, the end portion 119 of the end 118 is of enlarged inner diameter. This end portion 119 fits within the sleeve 30. The barrel 14 is movable from a rear position in which it extends to the rear of the sleeve 30 and contains the forward portion 50 of the breech 48 and a forward position (as shown in FIG. 1) in which only a portion thereof is within the sleeve 30.

A groove 120 is cut into the rear end 118 of the barrel 14 and receives therein the internal pin 114 carried by the sleeve 30. The groove 120 comprises three straight portions 122, 124 and 126 which are angularly spaced by about 90° and which are joined by equally angled inclined portions 128 and 130. The location of the rear straight groove portion 122 is such that when the pin 114 engages therein, the port 34 will register with the loading passage 26. The position of intermediate straight groove portion 124 is such that when the pin 114 engages therein, the port 34 will register with the eject passage 28 and the position of the front straight groove portion 126 is such that when the pin 114 engages therein the port 34 will be between the barrel 14 and the block 12.

The lock-up opening 109 is formed in the end portion 119 of the barrel 14. When the barrel 14 is in its rearmost position, this hole 109 registers with the hole 108 to receive the lock-up pin 96 as described above.

A pair of generally "U"-shaped guides 132 are provided on the barrel 14 having their arms 134 welded to the barrel 14 and being provided with aligned bores in their bases through which bores, the magazine 16 is received. Thus the barrel 14 is held thereby against rotational movement. A hand grip 136 secured to the barrel 14 surrounds and covers the guides 132.

A stop device is provided to control movement of cartridges out of the magazine. This device comprises a loop part 140 having an enlarged upper part 142 in which are pivoted respectively two levers 144 and 145 which are arranged axially spaced one before the other. Each lever has an anvil part 146 that is above the loop and an end lip 147 within the loop. The anvil parts 146 lie in the path of the cam 112. Levers 144 and 145 are arranged so that the front lip 147 is moved to permit a cartridge to pass it whereafter the cartridge engages the rear lip. On release of the rear lip, the cartridge moves below the loading opening while the next cartridge in the magazine engages the former lip to be held thereby in the magazine A lifter flap 148 is provided below the loader 146. This will be described below.

On the front of the forward portion 50 there is an ejector claw 154 and a pusher pin 156. The barrel 14 has a ramp 158 cut out adjacent the opening 109. When the barrel 14 is moved into its rear position, the claw 154 is moved outwardly by the ramp 158. As the barrel moves forwardly, the claw 154 runs down the ramp 158 to engage the rim of the cartridge case to hold this against forward movement and thus to draw it out of the bore 116. At the same time the pusher pin 156 urges the cartridge forwardly so that once the end of the barrel 14 clears the eject passage 28, the cartridge case will be ejected therethrough.

A safety pin (not shown) is provided which can engage in the opening 95 to prevent the rocker device 70 pivoting When moved the safety pin permits such pivoting. A further safety pin (not shown) is movable by a member on the hand grip of the firearm. When the hand grip is free this further safety pin passes through the opening 110 immobilising the sleeve 30 and with it the barrel 14.

The trigger guard 160 comprises a flat part 162 and a flat ramp 164 leading therefrom. This shape of the trigger guard serves to guide the cartridges into the magazine Thus the magazine can be loaded without inverting the firearm.

The lifting flap 166 is pivotally mounted having a rear projection 168. A flap extension 170 lies over the flap 166 and is also spring loaded upwardly. A depresser pin 172 is mounted in the block below a third cam member 174 on the rear of the breech 48 and this is arranged to engage a pivoted arm 176 that engages the projection 168. When the sleeve 30 is moved so that the port 34 is above the loading passage 26, the cam member 174 causes the pin depresser pin 172 to rock the arm 176 depressing the projection 168 and thus moving the flap 166 upwardly to lift the cartridge into the sleeve. As this lifting operation takes place, the flap extension 170 is also biassed upwardly so that the cartridge is loaded in an horizontal position.

In use, with the magazine charged, a person using the firearm first releases the safety catch. He grips the hand grip thereby releasing the further safety pin. The barrel 14 is moved forwardly. As the barrel 14 moves forwardly, the pin 114 runs along (a) the front straight portion 126 of the groove 12, and (b) then the inclined portion 132 when it causes the sleeve 20 to rotate into the position in which the port 34 is opposite the eject passage 28. Also at this time, the sleeve 30 rotates, the two cams 56 and 46 engage and cause the firing pin cam 44 to move backwardly against the biass of the spring. In so doing, the flange 45 rides over the sear 94 which is then is biassed upwardly to engage in the flange 45 and prevent forward movement of the firing pin cam 44 and the firing pin 60. Further forward movement continues until the pin 114 engages the inclined portion 130 moving the sleeve 30 so that the port 34 is opposite the loading passage age 26. At this juncture a cartridge is inserted into the sleeve 30 through the loading passage 26 and the port 34 by the loading flap and is aligned with the bore 116 of the barrel 14.

It will be noted that even at this stage the firing pin 60 is held against movement by the sear 94.

The barrel 14 is now moved rearwardly so that the cartridge is homed into the barrel bore 116. At the same time, the pin 114 moves in the opposite direction. When the barrel 14 is finally moved into its rearward position, the cartridge will be fully homed in the bore 116 of the barrel 14 and the sear 94 will still be engaging the flange 45. At this stage, the rear end 118 of the barrel 14 will surround the front portion 50 of the breech 48. Also the port 34 will be between the barrel 14 and the block 12.

When the trigger 68 is pulled, the rocker device 70 pivots as described above, first securing all the parts together by means of the lock-up pin 96 entering the openings 109 and 110. Only then is the sear 94 moved downwardly against the biassing compression spring 106 until the sear 94 is moved out of the path of the flange 45. The strong firing spring 65 urges the firing pin cam 44 forwardly under considerable force so that the firing pin 60 strikes the detonator cap causing the cartridge to be fired. It will be seen that at this point the cartridge is wholly within the rear end of the barrel 14 which together with the breech 48 can and does absorb all the explosive forces until the cartridge leaves the barrel. Only after the firing, and the release of the trigger, does the lock-up pin 96 move out of the openings 109 and 110 and the barrel 14 and sleeve 30 are free to be moved forwardly.

The process is then repeated as desired. It will be appreciated that on commencement of the forward movement of the barrel 14, the ejector claw 154 will act to hold the cartridge case preventing it from moving with the barrel and then the end pusher pin 156 will cause the casing to pivot about the ejector claw and be expelled out of the eject passage.

The trigger and the rocker member may both be made as steel pressings as is the trigger guard. The barrel is made from high tensile steel as is the sleeve. Many of the ancilliary parts such as the hand grip and the handle may be plastics mouldings.

It will be noted that by varying the cam characteristics, the amount of movement of the firing mechanism to fire the firearm can be changed. Furthermore the sweeping action of the cam member over the cam surface provides a self cleaning action foor the firing mechanism.

The firing mechanism thus provides a safe and simple mechanism which is easy and inexpensive to manufacture and convenient to operate in practice. It is also particularly strong and unlikely to be destroyed in normal usage.

The firearm described above has far fewer component parts than conventional shot guns. This permits considerable economies in construction and assembly as well as maintainance. Furthermore it permits the components to be of larger size and thus of greater robustness.

In addition, the moving barrel and sleeve arrangement permits the overall length of the firearm to be considerably reduced as compared to the length of a firearm having a barrel of the same length. This brings with it advantages in reductions of weight and costs of manufacture.

It will also be seen that all parts can be made on automatic machinery and no metal castings are used.

The invention is not limited to the precise constructional details hereinbefore described and illustrated. For example other types of magazines and feeds can be provided. Other firing mechanisms and release devices may be used.

The invention can be used with any point target weapon which is breech loaded although at present, it is contemplated that the maximum size of weapon would be one firing cartridges of 54mm diameter.

I claim:

1. A firearm comprising:

a. a main housing having
   - a.1 a main bore,
   - a.2 a loading passage through which a cartridge can be inserted into the main bore; and
   - a.3 an eject passage through which a cartridge case can be ejected from the main bore;

b. a breech at one end of the main bore;

c. a firing pin at the breech end of the main bore;

d. a sleeve rotatably fitting in the main bore and having
   - d.1 a port therein which corresponds in size and axial location to the loading passage;

e. a barrel having
   - e.1 a bore therethrogh which is shaped to inhibit the cartridge casing from passing along the barrel, and
   - e.2 a rear end that is telescopically received within the sleeve, the barrel being axially movable from a rear position in which it engaged the breech to a forward position; and f. engaging cam means and cam follower means formed on the barrel and sleeve to cause rotation of the sleeve on axial movement of the barrel;

the arrangement being such that when the barrel is in the forward position, the port will be adjacent the loading passage; and when the barrel is intermediate the front and rear position the port will be adjacent the eject passage.

2. A firearm as in claim 1 further comprising a pin carrier on which the firing pin is mounted, biasing means for biasing the pin carrier forwardly towards the barrel and means operative by the barrel on axial movement thereof to move the pin carrier rearwardly against the bias of the biasing means.

3. A firearm as in claim 2 further comprising rotatable cam surfaces operatively connected to the said sleeve for rotation therewith and axially movable cam surfaces engaging the said rotatable cam surfaces, the said axially movable cam surfaces being operatively connected to said pin carrier, which said cam surfaces engage when the sleeve is rotated to cause the pin carrier to move as aforesaid.

4. A firearm as in claim 1 in the form of a single acting firearm comprising a firing mechanism which comprises a trigger movable in use from a forward position to a firing position, a locking member movable between a locking position in which it locks the barrel in a rearward position and a free position in which it does not restrain movement of the barrel, the locking member being connected to the trigger for movement thereby into the locking position when the trigger is moved to its firing position, and a sear movable by the trigger, when the locking member is in the locking position, from a position in which it restrains the firing pin from forward movement to a release position in which it permits forward firing movement of the firing pin.

5. A firearm as in claim 4 further comprising a rocker device carrying the sear and the locking member and having a cam surface thereon, and in which the trigger member engages the cam surface;

the cam surface being arranged so that in use on initial movement of the trigger member from its forward position the rocker device is caused to move so that the locking member is moved into its locking position while on further movement of the trigger member, the sear is moved to its release position.

6. A firearm as in claim 1 in which the cam means comprises a cam groove in the barrel and the cam follower means comprises a pin on the sleeve.

7. A firearm as in claim 6 in which the groove comprises straight end portions with inclined connecting portions so that the initial and terminal axial movement of the barrel is unaccompanied by corresponding rotary movement of the sleeve.

8. A firearm as in claim 7 in which the groove further comprises an intermediate straight portion between the inclined connecting portions.

9. A firearm as in claim 7 including means for preventing the barrel from rotating relative to the main housing.

10. A firearm as in any one of the preceding claims incorporating a tubular magazine, and further comprising a lifting flap located adjacent the loading passage and having an extension flap which lies over it and on to which in use the cartridge is received from the magazine, there further being provided spring biasing means biasing the extension flap upwardly so that when the lifting flap is moved to lift the cartridge, the cartridge will be lifted in a position which is substantially parallel to the bore of the barrel.

11. A firearm as in claim 10 including a tubular magazine and a trigger guard, said trigger guard including a ramp leading towards the magazine whereby cartridges may be moved there along for loading the magazine.

12. A firearm as in any one of claims 1-5 including a tubular magazine and a trigger guard, said trigger guard including a ramp leading towards the magazine whereby cartridges may be moved there along for loading the magazine.

* * * * *